US008082753B1

(12) United States Patent
Alvarez, Jr. et al.

(10) Patent No.: US 8,082,753 B1
(45) Date of Patent: Dec. 27, 2011

(54) BEVERAGE BEAD

(75) Inventors: Patrick D. Alvarez, Jr., St. Augustine, FL (US); Joel A Salvador, San Antonio, TX (US); John Scott Phares, South Lyon, MI (US)

(73) Assignees: Patrick D. Alvarez, Jr., Metairie, LA (US); Joel A. Salvador, San Antonio, TX (US)

( * ) Notice: Subject to any disclaimer, the term of this patent is extended or adjusted under 35 U.S.C. 154(b) by 521 days.

(21) Appl. No.: 12/262,952

(22) Filed: Oct. 31, 2008

Related U.S. Application Data

(63) Continuation-in-part of application No. 11/534,755, filed on Sep. 25, 2006, now abandoned.

(60) Provisional application No. 60/724,363, filed on Oct. 5, 2005.

(51) Int. Cl.
*A44C 13/00* (2006.01)
*A45F 3/16* (2006.01)

(52) U.S. Cl. ..... 63/1.14; 63/3; 63/40; 224/148.1; 224/148.2; 224/148.5

(58) Field of Classification Search ..... D7/300, D7/300.1, 305; 224/148.5, 148.6, 148, 148.2, 224/148.1; 63/1.14; 220/501, 500, 507, 220/678, 677, 709, 705, 703, 754, 752; 215/6, 215/388, 387
See application file for complete search history.

(56) References Cited

U.S. PATENT DOCUMENTS

| | | | | |
|---|---|---|---|---|
| 2,713,543 | A * | 7/1955 | Peters | 426/116 |
| 3,779,021 | A * | 12/1973 | Green | 405/125 |
| 4,339,062 | A * | 7/1982 | Witt, Jr. | 224/148.4 |
| 4,702,473 | A | 10/1987 | Paquette | |
| 5,207,362 | A * | 5/1993 | Janus et al. | 224/148.2 |
| 5,207,719 | A * | 5/1993 | Janus | 224/148.2 |
| 5,261,570 | A | 11/1993 | Hippely et al. | |
| 5,431,308 | A | 7/1995 | Tchen | |
| 5,476,194 | A | 12/1995 | Hippely et al. | |
| 5,584,413 | A * | 12/1996 | Jung | 220/666 |
| 5,622,293 | A | 4/1997 | LeFevre | |
| 5,715,533 | A | 2/1998 | Stein | |
| 5,782,390 | A * | 7/1998 | Dorney | 224/148.6 |
| D398,879 | S | 9/1998 | Philipson et al. | |
| 5,896,756 | A | 4/1999 | Watkins | |
| 5,957,347 | A | 9/1999 | White et al. | |
| 6,581,811 | B1 * | 6/2003 | Schillaci | 224/148.2 |
| 6,598,770 | B2 | 7/2003 | Bolts | |
| 2004/0065703 | A1 * | 4/2004 | Bellucci | 224/148.5 |
| 2004/0134229 | A1 | 7/2004 | Oliver | |
| 2004/0211684 | A1 | 10/2004 | McClintock | |
| 2005/0035160 | A1 | 2/2005 | Forsman | |

* cited by examiner

*Primary Examiner* — Victor Batson
*Assistant Examiner* — Emily Morgan
(74) *Attorney, Agent, or Firm* — Garvey, Smith, Nehrbass & North, L.L.C.; Brett A. North

(57) ABSTRACT

Provided in one embodiment is a decorative beaded necklace for ornamental decoration, comprising a plurality of decorative compartments, each of the compartments being fluidly connected to each other; a tube, the tube being fluidly connected to at least one of the plurality of compartments; and a fluid inlet, the fluid inlet allowing fluid to be added to the plurality of compartments.

11 Claims, 9 Drawing Sheets

FIG. 13
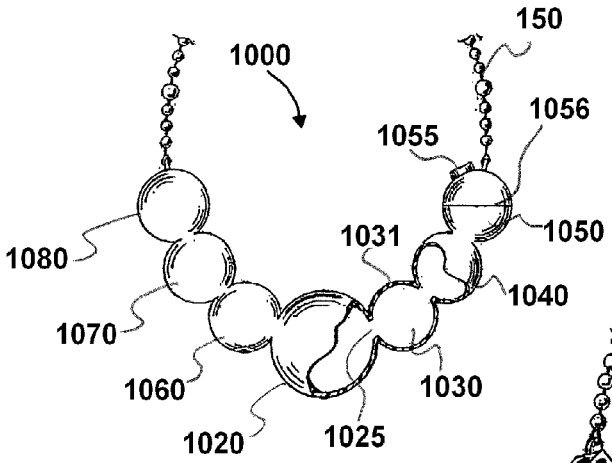
FIG. 14
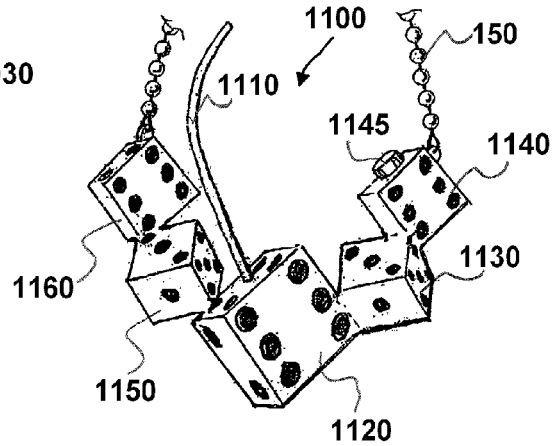
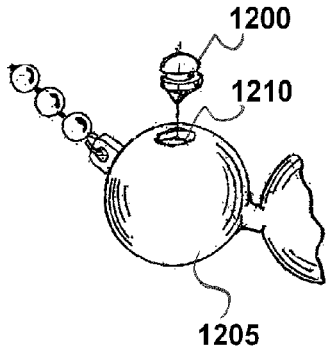
FIG. 15
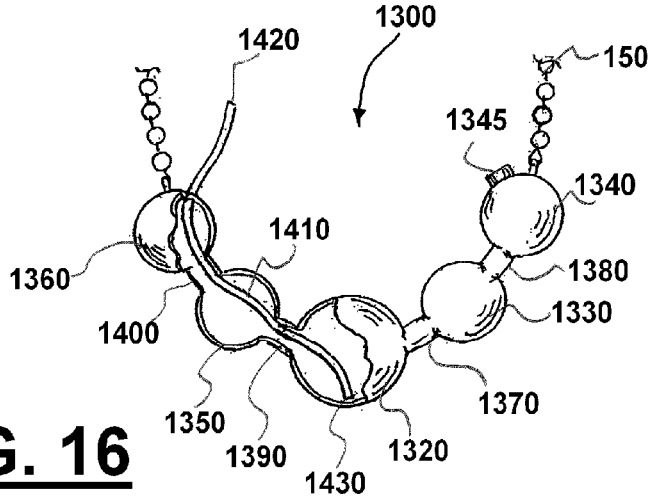
FIG. 16

BEVERAGE BEAD

CROSS-REFERENCE TO RELATED APPLICATIONS

This is a continuation in part of U.S. Ser. No. 11/534,755, filed Sep. 25, 2006, and incorporated herein by reference, is hereby claimed.

Priority of U.S. Provisional Patent Application Ser. No. 60/724,363, filed Oct. 5, 2005, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND

Ornamental decorations are often used at public events, festivals, parties, parades, and the like, to enliven the activities and enjoyments of the attendees. Among these well-known events are Mardi Gras, New Year's Eve events, Christmas parades, and other such celebratory public and private events. The ornamental decorations include signage, flags, hats, stylized costumes, and special jewelry and apparel decorations including buttons and necklaces. The manufacture and sales of such special articles and decorations has become a significant business. Attendees often purchase these special articles and decorations from stores, shops, and street vendors.

One type of such ornamental decoration is beaded necklaces. These necklaces typically use brightly colored, faceted beads strung onto an elongate cord for wearing around the neck. The beaded necklaces also typically include enlarged, stylized portions that are designed to catch the attention of festival attendees. Other similar beaded necklaces for festival participants are available from stores and street vendors. For example, many persons appearing on floats and in the streets during Mardi Gras parades wear such beaded necklaces, and often, persons on floats throw additional necklaces to persons observing the parades. Persons attending such events often use these beads as a badge of honor based on the "size" of the beads worn around the neck.

Also needed during festivals are containers for drinking fluids. There is a need to provide a decorative containers resembling necklaces which will allow individuals to have both hands free which containers fit within the theme of festival activities.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF SUMMARY

The apparatus of the present invention solves the problems confronted in the art in a simple and straightforward manner. In one embodiment is provided various decorative containers resembling necklaces.

The drawings constitute a part of this specification and include exemplary embodiments to the invention, which may be embodied in various forms.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 13 shows an alternative version of a container;

FIG. 14 shows an alternative version of a container;

FIG. 15 shows an alternative cap or plug for one or more of the versions of the container;

FIG. 16 shows an alternative version of the cap and the tube;

DETAILED DESCRIPTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

Figure 1:
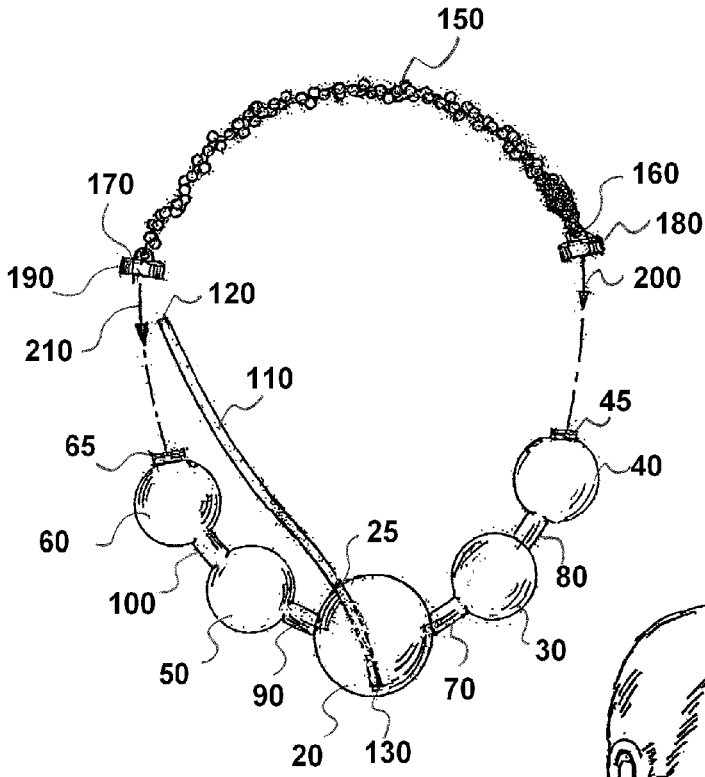
FIG. 1 shows one embodiment.

FIG. 1 shows one embodiment of container 10. Container 10 can comprise compartments 20, 30, 40, 50, 60, tube 110, and cord 150. Compartments 20, 30, 40, 50, 60 can be of hollow construction to contain a fluid or liquid. Compartments 20, 30 can be fluidly connected by connector 70. Compartments 30, 40 can be fluidly connected by connector 80. Compartments 20, 50 can be fluidly connected by connector 90. Compartments 50, 60 can be fluidly connected by connector 100. In such manner compartments 20, 30, 40, 50, 60 can be fluidly connected to each other. Connectors 70,80,90, 100 can be flexible or relatively rigid and preferably include fluid tight connections to any compartment of which they are connected. Additionally, connectors 70,80,90,100 can be removably connectable to one or more compartments for ease of cleaning.

Tube 110 can be fluidly connected to compartment 20 through opening 25. Tube 110 can comprise first end 120 and second end 130. A user can retrieve fluid from container 10 through first end 120. Preferably second end 130 is located adjacent the bottom of compartment 20 allowing for access to all fluid in container 10. Tube 110 can be removably connectable to compartment 20, such as through a sliding connection. Alternatively, tube 110 can be permanently connected to compartment 20.

Cord 150 can include first end 160 and second end 170. First end 160 can include first cap 180. Second end 170 can include second cap 190. First and second caps 180,190 can be rotatably or pivotally connected to cord 150.

First and second caps 180,190 can be used to add fluid to container 10. First cap 180 can be threadably connected to opening 45 of compartment 40 (as indicated by arrow 200). Second cap 190 can be threadably connected to opening 65 in compartment 60 (as indicated by arrow 210).

Figure 2:
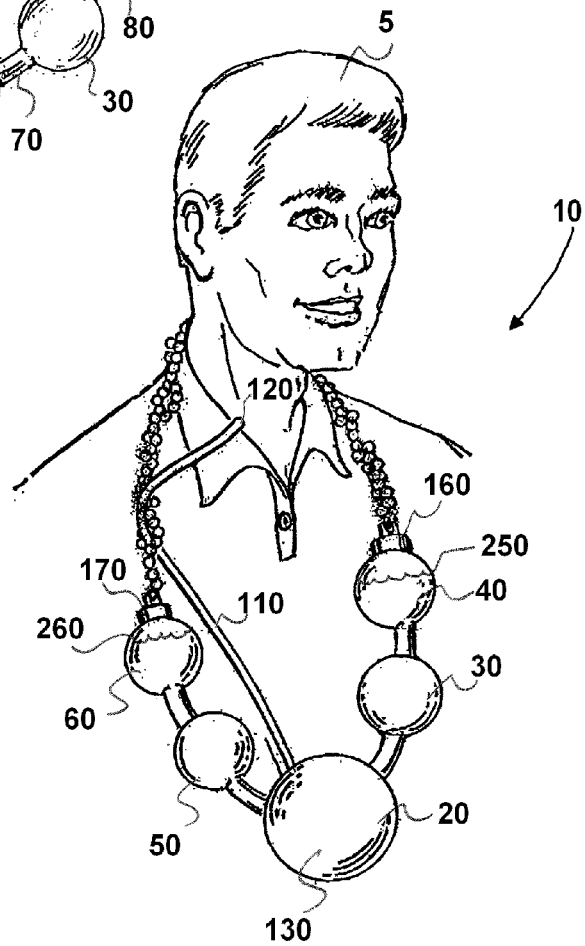
FIG. 2 shows the container of FIG. 1 being worn by an individual.

Container 10 can be filled with a fluid through either opening 45 or 65. In FIG. 2 container 10 is shown filled with a fluid having fluid levels 250,260. Because compartments 20, 30, 40, 50, 60 are fluidly connected to each other fluid fills each compartment. Where a drink is desired individual 5 merely sips on first end 120 of tube 110. As fluid is removed through tube 110, fluid levels 250,260 will drop, first entering compartments 30,60, and finally entering compartment 20. After substantially all fluid is removed through tube 110, container 10 can be refilled through either opening 45 and/or 65.

Cord 150 can be constructed to resemble or comprise a plurality of decorative bead elements, such as those thrown in Mardi Gras parades or other festivals. Compartments 20, 30, 40, 50, 60 can be constructed to resemble a plurality of decorative bead elements such as those thrown in Mardi Gras parades or other festivals. In this manner container 10 can resemble a set of decorative beads when worn by an individual 5 (as shown in FIG. 2).

Figure 3:
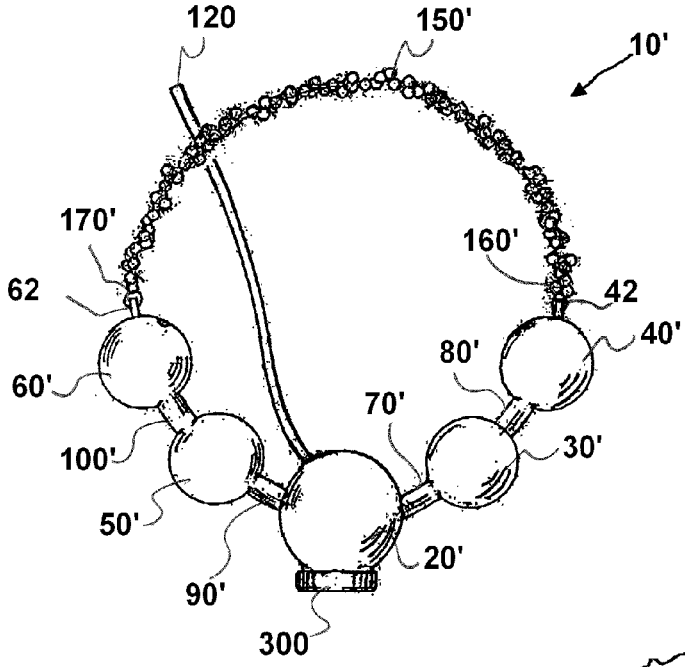
FIG. 3 shows an alternative version of the container of FIG. 1 with a cap on the bottom of the largest compartment.
Figure 4:
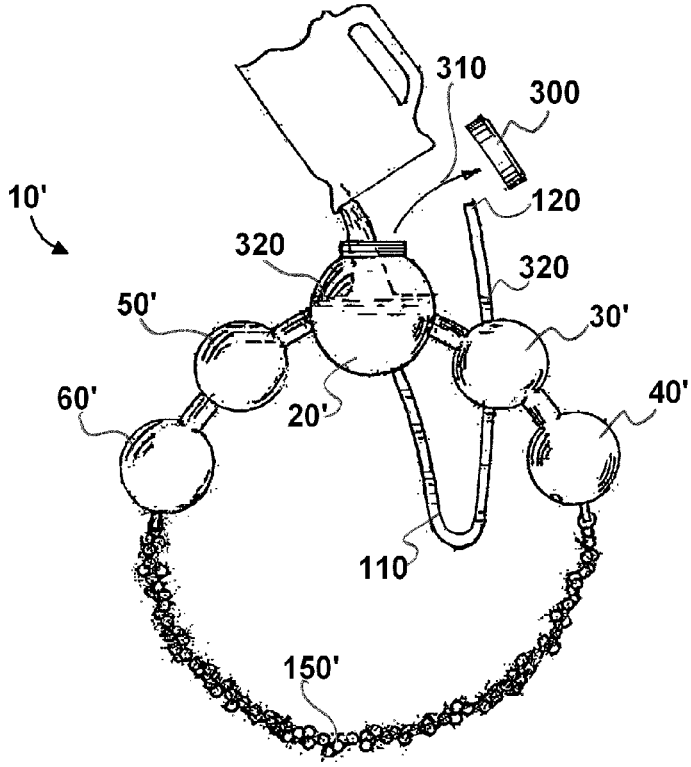
FIG. 4 shows the container of FIG. 3 being filled with a beverage.

FIGS. 3 and 4 show an alternative container 10' having a cap 300 on the bottom of the largest compartment 20'. Container 10' can comprise compartments 20', 30', 40', 50', 60', tube 110, and cord 150'. Compartments 20', 30', 40', 50', 60' can be of hollow construction to contain a fluid or liquid. Compartments 20', 30' can be fluidly connected by connector 70'. Compartments 30', 40' can be fluidly connected by connector 80'. Compartments 20', 50' can be fluidly connected by connector 90'. Compartments 50', 60' can be fluidly connected by connector 100'. In such manner compartments 20', 30', 40', 50', 60' can be fluidly connected to each other. Connectors 70',80',90',100' can be flexible or relatively rigid and preferably include fluid tight connections to any compartment of which they are connected. Additionally, connectors 70',80',90',100' can be removably connectable to one or more compartments for ease of cleaning.

Tube 110 can be fluidly connected to compartment 20'. A user can retrieve fluid from container 10' through first end 120. Preferably second end 130 (not shown) is located adjacent the bottom of compartment 20' allowing for access to all fluid in container 10'. Tube 110 can be removably connectable to compartment 20', such as through a sliding connection. Alternatively, tube 110 can be permanently connected to compartment 20'.

Cord 150' can include first end 160' and second end 170'. First end 160' can be connected to attachment point 42 of compartment 40'. Second end 170' can be connected to attachment point 62 of compartment 60'. Attachment points 42,62 can be rotatably or pivotally connected to cord 150'.

FIG. 4 illustrates the process of filling container 10' with a fluid 320. Cap 300 can be removed to add fluid to container 10' (as indicated by arrow 310). Cap 300 can be threadably connected to container 20' and preferably makes a fluid tight seal. Because compartments 20', 30', 40', 50', 60' are fluidly connected to each other, fluid 320 fills each compartment. During the process of filling first end 120 of tube 110 is preferably at a higher elevation than compartment 20'. After filling is completed cap 300 is placed back on compartment 20' making a fluid tight seal. Where a drink is desired individual 5 (not shown) turns over container 10' and merely sips on first end 120 of tube 110. As fluid is removed through tube 110, fluid 320 drains out of compartments 40',60'; next draining out of compartments 30',60', and finally draining out of compartment 20'. After substantially all fluid 320 is removed through tube 110, container 10' can be refilled through removal of cap 300.

Figure 5:
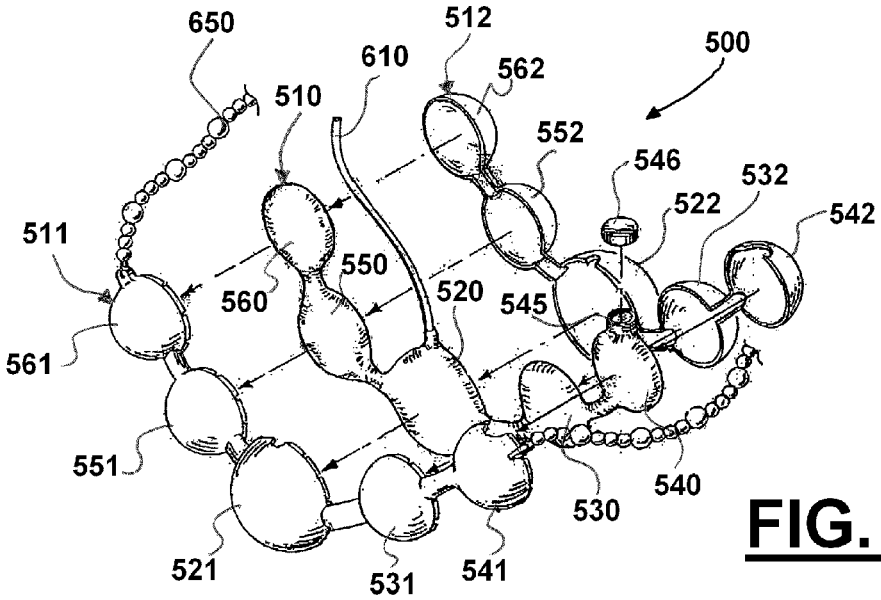
FIG. 5 shows an alternative version of a container.

FIG. 5 shows container 500 comprising bladder 510 along with first and second covers 511,512 and cord 650. Bladder 510 can be a single unit and having tube 610 integrally formed therein. Bladder 510 can comprise compartments 520, 530, 540, 550, 560, opening 545, and cap 546. Compartments 520, 530, 540, 550, 560 can be fluidly connected to each other. First cover 511 can comprise sections 521, 531, 541, 551, and 561. Second cover 512 can comprise sections 522, 532, 542, 552, and 562. Sections 521, 531, 541, 551, and 561 of first cover 511 can fit compartments 520, 530, 540, 550, and 560 of bladder 510. Sections 522, 532, 542, 552, and 562 of second cover 512 can fit compartments 520, 530, 540, 550, and 560 of bladder 510. First cover 511 can interconnect with second cover 512 thereby containing bladder 510. Sections 541 and 542 can include openings to accept opening 545 and cap 546.

Cord 650 can be attached to first cover 511. Alternatively, cord 650 can be attached to second cover 512. Also alternatively, cord 650 can be attached to both first and second covers 511,512 (e.g., one end of cord 650 being attached to first cover 511 and the second end of cord 650 being attached to second cover 512). Also alternatively, cord 650 can be attached to bladder 510.

Cord 650 can be constructed to resemble or comprise a plurality of decorative bead elements, such as those thrown in Mardi Gras parades or other festivals. First and second covers can be constructed to resemble a plurality of decorative bead elements such as those thrown in Mardi Gras parades or other festivals. In this manner container 500 can resemble a set of decorative beads when worn by an individual 5.

Figure 6:
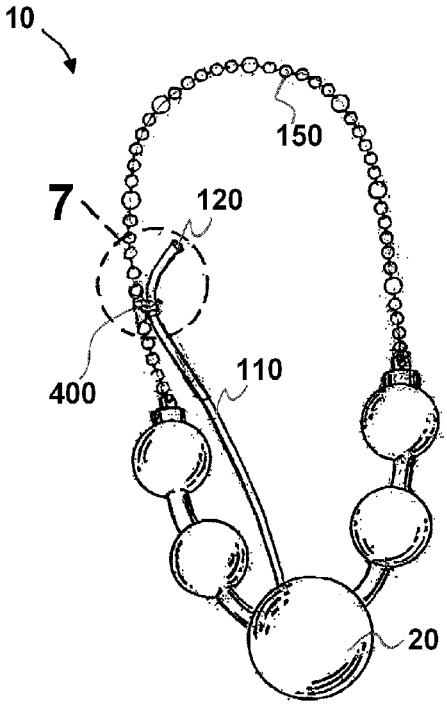
FIG. 6 shows the container of FIG. 1 having a clip for the tube.
Figure 7:
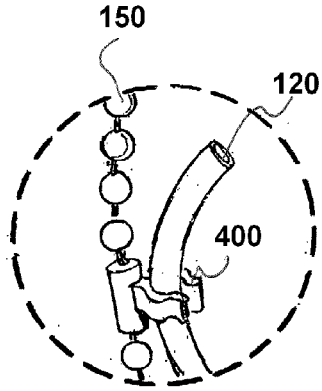
FIG. 7 shows an enlarged view of the clip.

FIG. 6 shows container 10 having a clip 400 for tube 110. FIG. 7 shows an enlarged view of clip 100. Clip 400 is shown detachably connecting tube 110 to cord 150. In this manner clip 400 can keep tube 110 out of the way of individual 5 until a drink is desired. Additionally, clip 400 can prevent first end 120 of tube 110 from sagging lower than the fluid level in container 10 thereby preventing inadvertent spillage of fluid from container 10.

Figure 8:
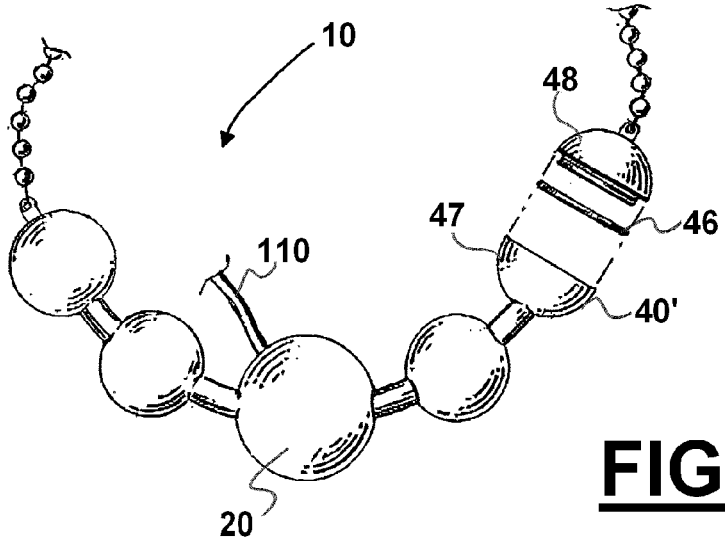
FIG. 8 shows an alternative version of a container.

FIG. 8 shows an alternative version of container 10. In this version compartment 40' can be separated into can include first section 47 and second section 48 which threadably connect to each other. First section 47 and second section 46 can be hemispheres. To facilitate sealing o-ring 46 can be used.

Figure 9:
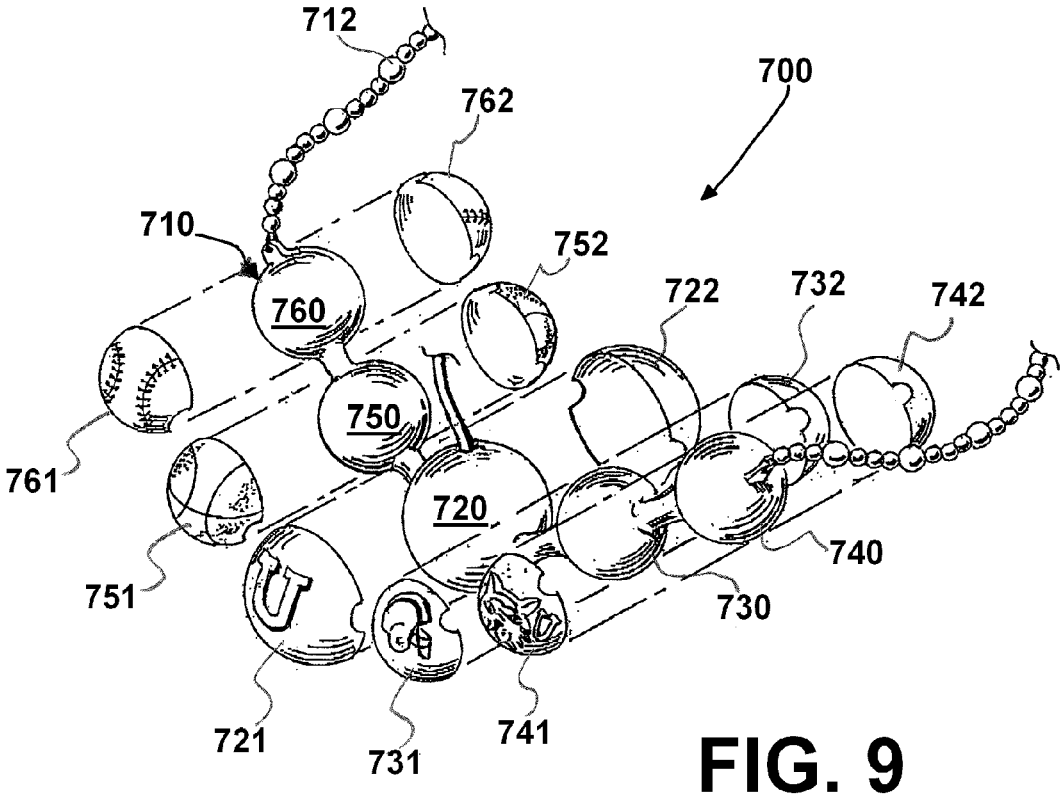
FIG. 9 shows a plurality of decorative coverings for versions of the container.

FIG. 9 shows a plurality of decorative coverings for decorated versions of the container 700. Container 700 can be of the construction as that of any of the other embodiments. This embodiment envisions the ability of the user to pick and choose what decorative covering will be used for container 700. For example sections 761 and 762 include a baseball theme; sections 751 and 752 include a basketball theme; sections 721 and 722 include a collegiate symbol or mascot theme; sections 731 and 732 include a football helmet theme (such as professional, collegiate, or highschool); and sections 741 and 742 include a figure such as an animal (e.g., mascot for professional, collegiate, or highschool). Sections can include similar or different decorative items. Additionally, in one embodiment, sets of sections with decorative items are provided where the user can mix and match (or change out) the theme to be displayed on container 700.

Figure 10:
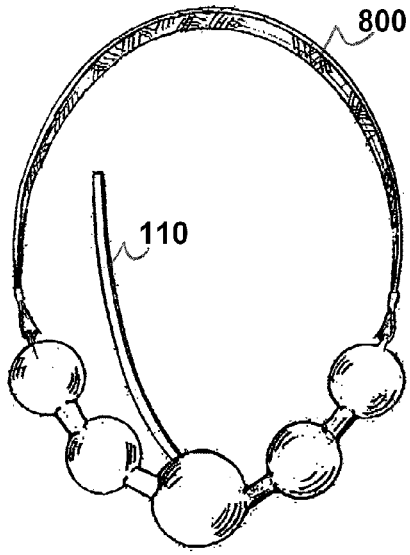
FIG. 10 shows an alternative strap.
Figure 11:
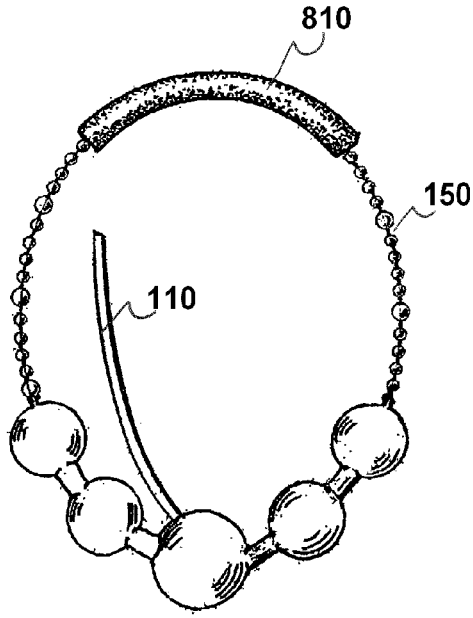
FIG. 11 shows an enlarged version of the strap.

FIGS. 10 and 11 show examples of alternative straps which can be used with any of the embodiments. In FIG. 10 enlarged widened strap 800 is shown. Strap 800 can be cloth, twine, plastic, foam, sponge, rubber, cord, string, or any other conventional material. Strap 800 is widened to increase comfort to individual 5 while wearing same. The widened area of strap 800 decreases the fatigue by spreading the weight of the container over a larger are of individual's 5 neck. FIG. 11 shows cord 150 with an enlarged are 810. As with widened strap 800 enlarged are 810 decreases fatigue by spreading the weight of the container over a larger are of individual's 5 neck. Enlarged area 810 can be foam rubber, cloth, twine, plastic, foam, sponge, rubber, cord, string, or any other conventional material.

Figure 12:
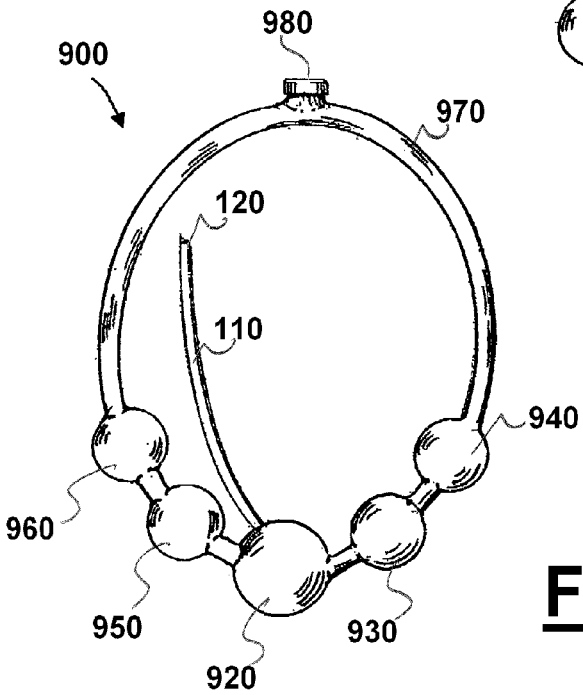
FIG. 12 shows an alternative version of a container.

FIG. 12 shows an alternative container 900. Container 900 can comprise compartments 920, 930, 940, 950, and 960, each of which are fluidly connected with each other. Additionally, container 900 can include tube 970 which is fluidly connected with compartments 940 and 960. Cap 980 can be used to fill container 900 with fluid. Tube 110 can be fluidly connected with compartment 920. Preferably, first end 120 of tube 110 will be higher than the level of fluid in container 900. Alternatively tube 110 can include a valve or cap which can restrict outflow of fluid until desired by the user.

FIG. 13 shows an alternative container 1000. Container 1000 can comprise compartments 1020, 1030, 1040, 1050, 1060, 1070, 1080, tube 110, and cord 150. Compartments 1020, 1030, 1040, 1050, 1060, 1070, 1080 can be of hollow construction (as shown by wall 1031) to contain a fluid or liquid. For example, compartments 1020, 1030 can be fluidly connected by opening 1025. Similarly, the other compartments can be fluidly connected by openings. In this embodiment connectors are omitted and the compartments are placed immediately adjacent to each other. Fluid 1056 is shown indicating that container 1000 is filled with a fluid or liquid. Cap 1055 can be used to fill container 1000.

FIG. 14 shows an alternative container 1100. Container 1100 can comprise compartments 1120, 1130, 1140, 1150, 1160, tube 110, and cord 150. Compartments 1120, 1130, 1140, 1150, 1160 can be of hollow construction to contain a fluid or liquid. Compartments can be fluidly connected by a plurality of openings (not shown). In this embodiment connectors are omitted and the compartments are placed immediately adjacent to each other. Cap 1145 can be used to fill container 1100. One or more of the compartments in container 1100 can be of a unique design. Shown are compartments resembling a plurality of dice, however, compartments of any shape, size, design, color can be used. For example, compartments resembling baseballs, soccer balls, basketballs, footballs, tennis balls, or other types of sporting goods equipment can be used. Additionally, decorative designs can be used for compartments such as diamonds, team logos or mascots (e.g., a fleur-de-lis for the New Orleans Saints football team), helmets, or logos for companies, parades, events, or other activities. Additionally, different novelty items can be used in the same container 1100.

Additionally, various designs can be affixed to the individual compartments regardless of what shape the individual compartments are made. For example compartment 20 can be of a special shape (or have a special design affixed thereon) while the remaining compartments have spherical shapes, with possible designs affixed thereon.

FIG. 15 shows an alternative cap or plug 1200 for one or more of the versions of the container. Plug can be a conventionally available plug which can resistantly fit in opening 1210 of compartment 1205.

FIG. 16 shows an alternative version of container and the tube. Container 1300 can comprise compartments 1320, 1330, 1340, 1350, 1360, tube 1410, and cord 150. Compartments 1320, 1330, 1340, 1350, 1360 can be of hollow construction to contain a fluid or liquid. Compartments 1320, 1330 can be fluidly connected by connector 1370. Compartments 1330, 1340 can be fluidly connected by connector 1380. Compartments 1320, 1350 can be fluidly connected by connector 1390. Compartments 1350, 1360 can be fluidly connected by connector 1400. In such manner compartments 1320, 1330, 1340, 1350, 1360 can be fluidly connected to each other. Connectors 1370,1380,1390,1400 can be flexible or relatively rigid and preferably include fluid tight connections to any compartment of which they are connected. Additionally, connectors 1370,1380,1390,1400 can be removably connectable to one or more compartments for ease of cleaning. Compartment 1340 can include cap 1345 for filling. Tube 1410 can be threaded through compartment 1360, connector 1400, compartment 1350, connector 1390, and compartment 1320. Such threading will place second end 1420 of tube 1410 closer to the mouth of the user and minimize the tendency of second end 1420 to move around while being worn by individual 5.

Many different types of tubes can be used—regular vinyl tubing, extendable flexible straw with ribbed baffles, and a flexible straw. Tubes can be flexible and/or accordion types. One or more tubes can enter enters one of the upper compartments, going through a plurality of compartments to the bottom compartment. One or more tubes can be used. In alternative embodiments the tube or tubes can be constructed to exit from the bottom, side, other positions from one or more of the compartments.

In alternative embodiments the compartments can have two male ends integrally formed with the compartments on which the connectors are attached thereby fluidly connecting two or more compartments. The male ends can be lined up and parallel with each other or placed in a non-parallel manner (such as being angled to the next compartment). Compartments can be injection molded plastic, can have a plurality of compartments, compartments have connectors separating compartments, compartments can be directly connected to each other (i.e., without connectors), connectors can thread into different compartments, connectors frictionally fit into openings in different compartments, connectors can be permanently affixed to different compartments, one or more compartments can have interchangeable decorative veneers. One or more compartments can be opened for access to inside of compartment and filling In alternative embodiments the internal bladder can be flexible, shaped with different compartments, or a decorative veneer placed over the bladder.

In alternative embodiments one or more caps can be used, such as different locations for cap being on top of largest compartment, on bottom of largest compartment, or on top of upper compartment. Additionally, the cap can be a screw cap or plug cap. Additionally, one or more of the caps can have a vent or air hole.

In alternative embodiments the strap can have large surface area to reduce strain on neck by weight of beverage container. The straps can have one or more protective sections such as foam rubber or cloth to reduce abrasion to neck.

In alternative embodiments, one or more insulating layers can be used. These insulating layers can include foam or metal layers.

In one or more embodiments the compartments can include interchangeable pieces, decorative pieces. For example, decorative compartments can include football, basketball, baseball, soccer, golf, tennis, soccer, dice, diamonds, spheres, pyramids, triangles, motorcycle helmets, animal characters, and fleur de lis (Saints logo). In one or more alternative embodiments the container can be used in theme and amusement parks and can include (or be in the form of) symbols or characters related to or sponsored by the theme parks or amusement parks In one or more alternative embodiments the various compartments can be injection, blow, or extrusion molded (or extrusion blow molded). In one embodiment each individual compartment can be separately blow molded having a wall thickness of about two millimeters. In one embodiment pairs of compartments can be placed in a mold and an outer 2 millimeter connecting ring can then be shot in forming a one piece connecting portion for the pairs of compartments.

In one embodiment each compartment can include a pair of one half connector pieces located on substantially opposite sides of the compartment (or angled to facilitate a curved connection), and be blow molded (with the end of each one half connector having a flanged area which flanged area can connect with a mating flanged area of the other one half connector from the next compartment). In one embodiment one of the flanged areas of the pair of mating one half connectors can include a recessed area for placing an o-ring which o-ring can be used to liquidly seal (and fluidly connect) the mating pair of one-half connectors (and adjacent compartments). In one embodiment each of the compartments can include opposed one half connectors with flanged ends, excepting the end compartments which can each include single one half connectors with flanged ends (which mate with the next adjacent compartment), but on the opposed sides of these end compartments can omit any connectors (and include only a sealed area), or include a threaded opening for an end cap detachable seal such end compartment.

In one embodiment a heat shrinkable material can be used to permanently connect adjacent compartments (by connecting their mating two one half connectors—which heat shrinkable material can be a rubber, plastic, or other polymer material). In one embodiment each of the two one half connectors can be connected by an attachment ring which is fabricated from injection molded plastic (in this embodiment a two piece injection molding system could be placed around the mating pair of one half connectors and their mating flanged portions where the attachment ring can be formed by injection molded plastic placed in the two piece mold and forming the attachment ring around the two mating one half connectors and flanges of the two connectors). In this embodiment an o-ring between the mating flanges for better sealing can also be included. In one embodiment the attachment ring can be formed from two prefabricated connecting pieces which snap or glue together around the mating flanges of the pair of mating one half connectors. Various adhesives or glues can be used.

Figure 20:
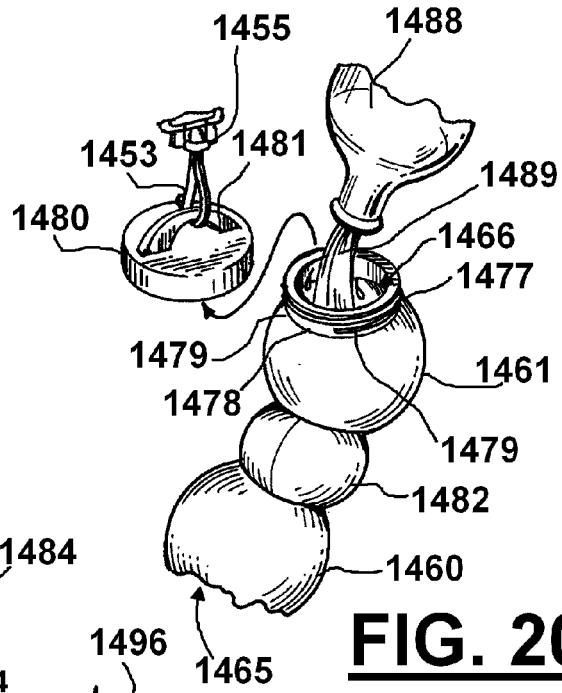
FIG. 20 is a partial perspective view of the embodiment of FIG. 17.
Figure 21:
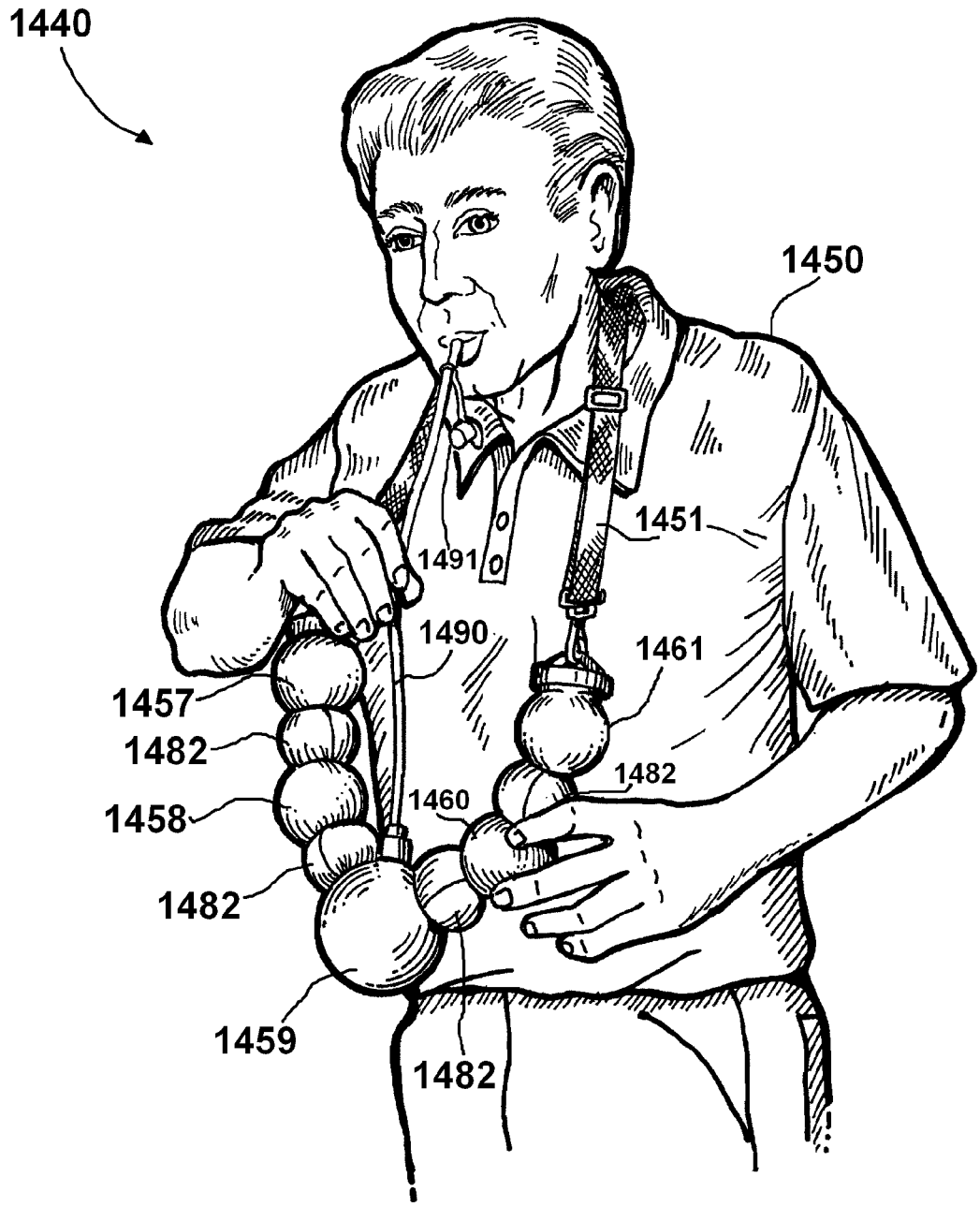
FIG. 21 is a perspective view of the additional embodiment of FIGS. 17-20.

FIGS. 17-21 show an additional embodiment of the apparatus of the present invention, designated generally by the numeral 1440. Container 1440 provides a strap 1451 for enabling the container 1440 to be placed around the neck of an individual or user 1450 as shown in FIG. 21. Strap 1451 can provide end portions having hooks 1452, 1453. Swivels can be used in between each hook 1452 or 1453 and strap 1451. The hook 1452 has a swivel 1454. The hook 1453 has a swivel 1455. A buckle 1456 or other adjustment can be provided for enabling the length of strap 1451 to be changed to fit the needs of a particular individual or user 1450.

Figure 17:
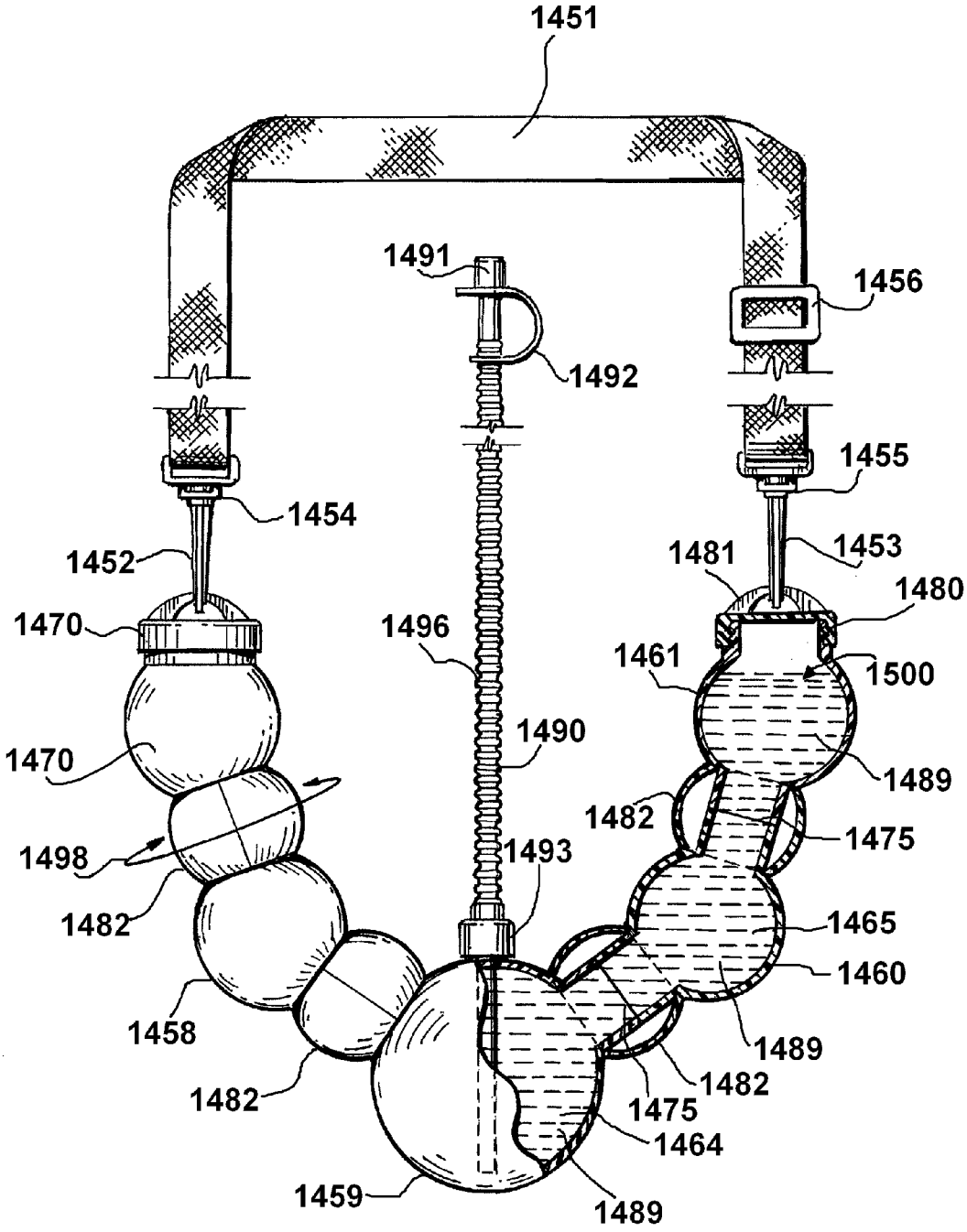
FIG. 17 is a frontal elevation, partially cutaway view of another embodiment of the apparatus of the present invention.
Figure 19:
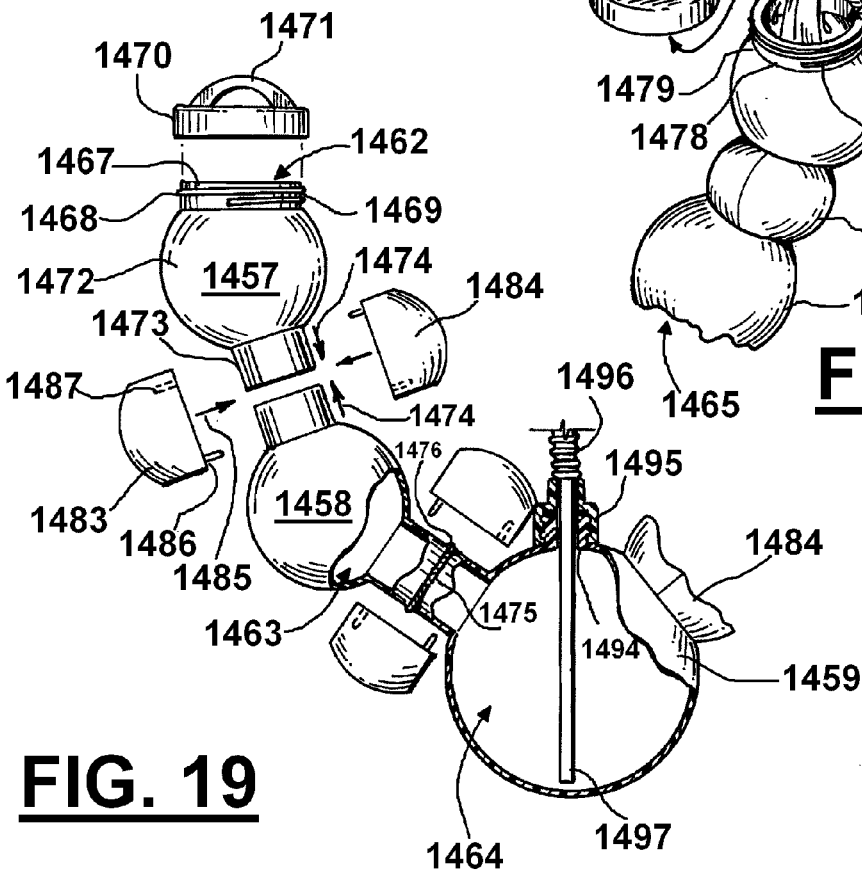
FIG. 19 is a partial sectional elevation and exploded view of the embodiment of FIG. 17.

Container 1440 provides a plurality of compartments 1457, 1458, 1459, 1460, 1461. Each of these compartments provides an interior for holding a liquid or slurry to be consumed by user/individual 1450. Compartment 1457 provides interior 1462. Compartment 1458 provides interior 1463. Compartment 1459 provides interior 1464. Compartment 1460 provides interior 1465. Compartment 1461 provides interior 1466. Each of these interiors 1462-1466 is in fluid communication with another interior next to it (see FIGS. 17, 19). As shown in FIGS. 17 and 19, a joint 1475 (which can be a weld or an adhesive joint or other joint) is provided between the two compartments such as 1458 and 1459 which are next to each other. In FIG. 19, this joint 1475 is shown. The joint 1475 can provide a bead 1476 such as a weld bead or an adhesive bead.

In order to add a liquid or slurried content to the various interiors 1462-1466 of container 1440, one or more inlets 1467, 1477 are provided. Each inlet 1467, 1477 can provide a threaded sleeve that is threaded to receive a closure cap. In FIG. 19, inlet 1467 provides a threaded sleeve 1468 having an external thread 1469. Closure cap 1470 could be internally threaded, having a thread that engages the external thread 1469 of threaded sleeve 1468. In order to rotate closure cap 1470, the closure cap 1470 can be provided with a gripping surface such as a handle 1471 or lugs or grips.

Another closure cap 1480 can be provided for sealing the second inlet 1477 that is provided on compartment 1461 as shown in FIGS. 17 and 20. Inlet 1477 provides an externally threaded sleeve 1478 having thread 1479. Closure cap 1480 provides a gripping surface such as a handle 1481. In FIG. 20, a supply bottle 1488 containing a desired liquid or slurry 1489 to be consumed is shown being added to inlet opening 1477.

Each joint 1475 is a circumferential or annular joint that does not interfere with the flow of fluid from one compartment 1457-1461 to the next compartment 1457-1461. For example, liquid that is added to inlet 1467 will flow through compartment 1457 to compartment 1458 to the bottom compartment 1459. That liquid will continue to flow upwardly into compartments 1460 and 1461, seeking its own liquid level 1500 (see FIG. 17). Thus, a user 1450 can add liquid to either of the inlet openings 1467, 1477 in order to fill each of the interiors 1462-1466 for maximum liquid holding capacity. Maximum capacity is reached when level 1500 is up to each of the inlet openings 1467, 1477.

Each compartment 1457 preferably includes a generally spherically shaped part 1472 (i.e. a whole sphere or a part of a sphere) and a cylindrically shaped part 1473. In FIG. 19, arrows 1474 illustrate the joining of the two spherical parts 1473 of the adjacent compartments 1457, 1458. The joint 1475 can be an adhesive formed or a welded bead 1476 joint such as a heat welded or sonic welded joint or bead.

A veneer or cover 1482 is placed over each of the joints 1475. The veneer or cover 1482 can also be placed over the cylindrical sections 1473 of adjacent compartments 1457-1461.

Figure 18:
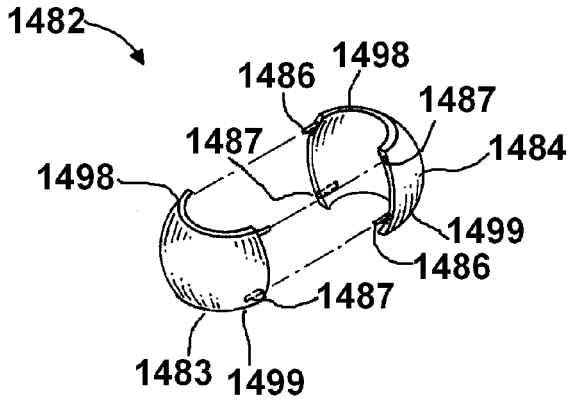
FIG. 18 is a fragmentary view of the embodiment of FIG. 17.

In FIGS. 18 and 19, cover or veneer 1482 is shown as comprised of a pair of sections 1483, 1484 each being generally hemispherically shaped. Each section 1483, 1484 provides one or more projections 1486 and/or one or more sockets 1487. The projections 1486 and sockets 1487 interlock to hold the sections 1483, 1484 together. Adhesive can also be used to join the projections 1486 and sockets 1487 when connecting two sections 1483, 1484 together. This assembly is illustrated by arrows 1485 in FIG. 19.

An edge 1498, 1499 can be provided for each section 1483, 1484. These edges 1498, 1499 can be shaped to fit against or conform to the outer surface of each of the adjacent compartments as seen in FIGS. 17-21.

Tube or drinking straw 1490 enables a user 1450 to remove liquid from the interiors 1462-1466 of the compartments 1457-1461. Because each of the fluid compartments 1457-1461 are in fluid communication, the user withdraws liquid via tube/drinking straw 1490 from compartment 1459. As liquid is removed via tube/drinking straw 1490 from compartment 1459, liquid 1489 drains downwardly into compartment 1459 from the other compartments 1457, 1458, 1460, 1461.

Tube/drinking straw 1490 can be provided with a closure cap 1491 attached to straw or tube 1490 using a strap 1492 or other tether or like connector. An annular flange 1493 enables a connection to be formed between outlet 1494 on compartment 1459 and tube/drinking straw 1490. A threaded connection can be provided at 1495 for connecting outlet 1494 to annular flange 1493. Straw or tube 1490 can provide a corrugated flexible part 1496 and a lower end 1497 that extends to the bottom of compartment 1459.

Each compartment 1457-1461 and each cover/veneer 1482 can be of other shapes such as blocks, diamonds, pears, hearts, stars, pyramids, animal shapes, human shapes, as a few examples to illustrate.

In other embodiments the compartments 1457-1461 and each cover/veneer 1482 can be of different molded shapes including animal, mascot, logo, animal mascot, dice, football, basketball, baseball, soccer ball, hockey puck, helmets, letters, numbers, golf ball, basic shapes, people, characters, and faces.

In one embodiment cover or veneer 1482 can be rotatable relative to one or more of the compartments 1457, 1458, 1459, 1460, and/or 1461. Such relative rotation is schematically indicated by arrow 1498 in FIG. 17. In one embodiment each of the covers or veneers can be rotatable. In one embodiment one or more of the covers or veneers 1482 can be of a generally different shape than one or more of the compartments 1457, 1458, 1459, 1460, and/or 1461.

In one embodiment one or more of the compartments 1457, 1458, 1459, 1460, and/or 1461 can be of a different shape or configuration than one or more of the other compartments 1457, 1458, 1459, 1460, and/or 1461. For example, the shapes can be dice, footballs, baseball, tigers, etc. For example, a theme may be a football theme with the compartments 1457, 1458, 1459, 1460, and/or 1461 could be in the shape of helmets and the covers or veneers 1482 could be in the shape of footballs. Other examples could be hats and baseballs, hats and gloves, hats and bats.

In other embodiments the compartments 1457, 1458, 1459, 1460, and/or 1461 could be of different colors from one or more of the other compartments and/or from one or more of the covers or veneers 1482. In one embodiment the compartments can be of one color and the covers or veneers could be of a different color.

In various embodiments the compartments and covers or veneers could be of a school's colors and include a schools logo.

In one embodiment the method and apparatus can follow a theme of a festival or Mardi Gras parade association and be thrown off of floats. In one embodiment the method and apparatus can be offered in theme parks.

The following is a list of reference numerals:

LIST FOR REFERENCE NUMERALS

| (Part No.) | (Description) |
|---|---|
| 5 | individual |
| 10 | container |
| 20 | compartment |
| 25 | opening |
| 30 | compartment |
| 40 | compartment |
| 42 | attachment point |
| 45 | opening |
| 46 | o-ring |
| 47 | first section |
| 48 | second section |
| 50 | compartment |
| 60 | compartment |
| 62 | attachment point |
| 65 | opening |
| 70 | connector |
| 80 | connector |
| 90 | connector |
| 100 | connector |
| 110 | tube |
| 120 | first end |
| 130 | second end |
| 150 | cord |
| 160 | first end |
| 170 | second end |
| 180 | cap |
| 190 | cap |
| 200 | arrow |
| 210 | arrow |
| 250 | fluid |
| 260 | fluid |
| 300 | cap |
| 310 | arrow |
| 320 | fluid |
| 400 | clip |
| 500 | container |
| 510 | bladder |
| 511 | first cover |
| 512 | second cover |
| 520 | compartment |
| 521 | section |
| 522 | section |
| 530 | compartment |
| 531 | section |
| 532 | section |
| 540 | compartment |
| 541 | section |
| 542 | section |
| 545 | opening |
| 546 | cap |
| 550 | compartment |
| 551 | section |
| 552 | section |
| 560 | compartment |
| 561 | section |
| 562 | section |
| 610 | tube |
| 650 | cord |
| 700 | container |
| 710 | bladder |
| 712 | cord |
| 720 | compartment |
| 721 | section |
| 722 | section |
| 730 | compartment |

-continued

LIST FOR REFERENCE NUMERALS

| (Part No.) | (Description) |
|---|---|
| 731 | section |
| 732 | section |
| 740 | compartment |
| 741 | section |
| 742 | section |
| 750 | compartment |
| 751 | section |
| 752 | section |
| 760 | compartment |
| 761 | section |
| 762 | section |
| 800 | strap |
| 810 | enlarged area |
| 900 | container |
| 920 | compartment |
| 930 | compartment |
| 940 | compartment |
| 950 | compartment |
| 960 | compartment |
| 970 | tube |
| 980 | cap |
| 1000 | container |
| 1020 | compartment |
| 1025 | opening |
| 1030 | compartment |
| 1031 | wall |
| 1040 | compartment |
| 1050 | compartment |
| 1055 | cap |
| 1056 | fluid |
| 1060 | compartment |
| 1070 | tube |
| 1100 | container |
| 1110 | tube |
| 1120 | compartment |
| 1130 | compartment |
| 1140 | compartment |
| 1145 | cap |
| 1150 | compartment |
| 1160 | compartment |
| 1200 | plug |
| 1205 | compartment |
| 1210 | opening |
| 1300 | container |
| 1320 | compartment |
| 1330 | compartment |
| 1340 | compartment |
| 1350 | compartment |
| 1360 | compartment |
| 1370 | connector |
| 1380 | connector |
| 1390 | connector |
| 1400 | connector |
| 1410 | tube |
| 1420 | first end |
| 1430 | second end |
| 1440 | container |
| 1450 | individual/user |
| 1451 | strap |
| 1452 | hook |
| 1453 | hook |
| 1454 | swivel |
| 1455 | swivel |
| 1456 | buckle |
| 1457 | compartment |
| 1458 | compartment |
| 1459 | compartment |
| 1460 | compartment |
| 1461 | compartment |
| 1462 | interior |
| 1463 | interior |
| 1464 | interior |
| 1465 | interior |
| 1466 | interior |
| 1467 | inlet |
| 1468 | threaded sleeve |

-continued

LIST FOR REFERENCE NUMERALS

| (Part No.) | (Description) |
|---|---|
| 1469 | thread |
| 1470 | closure cap |
| 1471 | handle |
| 1472 | spherically shaped part |
| 1473 | cylindrically shaped part |
| 1474 | arrow |
| 1475 | joint |
| 1476 | weld/adhesive bead |
| 1477 | inlet |
| 1478 | threaded sleeve |
| 1479 | thread |
| 1480 | closure cap |
| 1481 | handle |
| 1482 | veneer/cover |
| 1483 | section |
| 1484 | section |
| 1485 | arrow |
| 1486 | projection |
| 1487 | socket |
| 1488 | supply bottle |
| 1489 | liquid/slurry |
| 1490 | tube/drinking straw |
| 1491 | closure cap |
| 1492 | strap/tether |
| 1493 | annular flange |
| 1494 | outlet |
| 1495 | threaded connection |
| 1496 | flexible part |
| 1497 | lower end |
| 1498 | edge |
| 1499 | edge |
| 1500 | fluid level |

All measurements disclosed herein are at standard temperature and pressure, at sea level on Earth, unless indicated otherwise. All materials used or intended to be used in a human being are biocompatible, unless indicated otherwise.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A necklace, comprising:

(a) a necklace body in the form of a plurality of bead compartments, each bead compartment having a spherical portion, a cylindrically shaped portion and an interior, the plurality of interiors providing a liquid holding space, the necklace body including a pair of end bead compartments;

(b) each bead compartment engaging an adjacent bead compartment along a circumferential joint formed by connecting adjacent cylindrically shaped portions, each interior is in fluid communication with an interior of an adjacent bead compartment, all interiors forming a combined interior;

(c) a tube connected to at least one of the plurality of bead compartments, the tube enabling a user to drink fluid from the combined interior via the tube;

(d) a fluid inlet that enables fluid to be added to the combined interior, (e) a strap connected at strap ends to the end bead compartments, the strap enabling the necklace body to be supported by the neck of the user.

2. The beaded necklace of claim 1, further comprising a plurality of pairs of veneer sections, which can be attached to and hide the circumferential joint.

3. The necklace of claim 1, the joint includes an adhesive.

4. The necklace of claim 1, wherein each joint is covered with a cover.

5. The necklace of claim 4, wherein each cover is spherically shaped.

6. The necklace of claim 2, wherein each veneer section is shaped as a part of a sphere.

7. A decorative beaded necklace for ornamental decoration, comprising:

(a) a necklace body having a reservoir including a plurality of compartments, each of the compartments having a spherical portion, and a cylindrical portion, the compartments connected together by the cylindrical portions;

(b) a tube connected to the reservoir, the tube enabling a user to drink fluid from the compartments via the tube;

(c) an inlet that enables fluid to be added to one or more of the compartments;

(d) a plurality of decorative veneer sections covering the plurality of cylindrical portions.

8. The necklace of claim 7 wherein pairs of the plurality of veneer sections form a sphere.

9. The necklace of claim 7, wherein one of the compartments provides an enlarged volume having more liquid holding capacity than any other of the compartments.

10. The necklace of claim 7, wherein a second inlet is included which is spaced apart from the first inlet, the second inlet also allowing fluid to be added to one or more of the plurality of compartments.

11. The necklace of claim 7, wherein a cylindrical portion is connected to another cylindrical portion by a welded joint.

* * * * *